US005432011A

United States Patent [19]

DuBois et al.

[11] Patent Number: 5,432,011

[45] Date of Patent: Jul. 11, 1995

[54] ALUMINUM ALLOYS, SUBSTRATES COATED WITH THESE ALLOYS AND THEIR APPLICATIONS

[75] Inventors: Jean-Marie DuBois, Pompey; Antoine Pianelli, Heillecourt, both of France

[73] Assignee: Centre National de la Recherche Scientifique, Paris, France

[21] Appl. No.: 303,127

[22] Filed: Sep. 8, 1994

Related U.S. Application Data

[63] Continuation of Ser. No. 934,627, Noted as PCT/FR 92/00030 30, Jan. 15, 1992

[30] Foreign Application Priority Data

Jan. 18, 1991 [FR] France ..... 91 00549

[51] Int. Cl.[6] ..... B22F 7/04; C22C 21/00

[52] U.S. Cl. ..... 428/553; 428/650; 420/532; 420/538; 420/535

[58] Field of Search ..... 428/546, 548, 553, 650; 420/532, 538, 535

[56] References Cited

U.S. PATENT DOCUMENTS

| | | | |
|---|---|---|---|
| 4,595,429 | 6/1986 | Le Caé et al. | 148/403 |
| 4,710,246 | 12/1987 | Le Caé et al. | 148/403 |
| 4,731,133 | 3/1988 | Dermarkar | 148/437 |
| 4,743,317 | 5/1988 | Skinner et al. | 148/437 |
| 4,909,867 | 3/1990 | Matsumoto et al. | 148/403 |
| 5,053,085 | 10/1991 | Matsumoto et al. | 148/403 |
| 5,204,191 | 4/1993 | Dubois et al. | 428/650 |

FOREIGN PATENT DOCUMENTS 0356287 2/1990 European Pat. Off. .

OTHER PUBLICATIONS

Shechtman et al., "Metallic Phase with Long-Range Orientational Order and No Translational Symmetry," *Physical Review Letters*, vol. 53, No. 20, Nov. 12, 1984, pp. 1951–1953.

Li et al., "Orthorhombic Crystalline Approximents of the Al-Mn-Cu Decagonal Quasicrytal," *Philosophical Magazine B*, vol. 66, No. 1, 1992, pp. 117–124.

Daulton et al., "The Decagonal Phase in $(Al,Sil_{56}Co_{20}$-$Cu_{15}$ Alloys," *Philosophical Magazine B*, vol. 66, No. 1, 1992, pp. 37–61.

Edagawa et al., "Icosahedral and Approximant Phases in a Mg-Ga-Al-Zn Alloy and Their Electrical Resistivities," *Philosophical Magazine B*, vol. 65, No. 5, 1992, pp. 1011–1023.

(List continued on next page.)

*Primary Examiner*—Donald P. Walsh
*Assistant Examiner*—John N. Greaves
*Attorney, Agent, or Firm*—Foley & Lardner

[57] ABSTRACT

The present invention relates to alloys in which the essential constituent is aluminum, metal deposits produced from these alloys, substrates coated with these alloys and the applications of these alloys. The alloys of the present invention are characterized in that they have the following atomic composition: $Al_aCu_bCo_b$, $(B,C)_cM_dN_eI_f$; $a+b+b'+c+d+e+f=100$, expressed as number of atoms, $a \geqq 50$, $0 \leqq b < 14$, $0 \leqq b' \leqq 22$, $0 < b+b' \leqq 30$, $0 \leqq c \leqq 5$, $8 \leqq d \leqq 30$, $0 \leqq e \leqq 4$, $f \leqq 2$, where M represents one of more elements chosen from Fe, Cr, Mn, Ni, Ru, Os, Mo, V Mg, Zn and Pd; N represents one or more elements chosen from W, Ti, Zr, Hf, Rh, Nb, Ta, Y, Si, Ge and the rare earths; I represents the inevitable production impurities; and they contain at least 30% by mass of one or more quasicrystalline phases.

25 Claims, 2 Drawing Sheets

OTHER PUBLICATIONS

Tsai, "A Stable Quasicrystal in Al-Cu-Fe System," *Journal of Applied Physics,* vol. 26, No. 9, pp. 1506-1507.

Bendersky, "Quasicrystal with One-Dimensional Translational Symmetry and a Tenfold Rotation Axis," *Physical Review Letters,* vol. 55, No. 14, Sep. 30, 1985, pp. 1461-1463.

Dubois et al., "Diffraction Approach to the Structure of Decagonal Quasi-Crystals," *Physics Letters A,* vol. 117, No. 8, Sep. 8, 1986, pp. 421-427.

Audier et al., "Microcrystalline AlFaCu Phase of Pseudo loocahedral Symmtery," *World Scientific,* Singapore, 1989, pp. 74-91.

Dong et al., "Quasicrystals and Crystalline Phases in $Al_{65}Cu_{30}Fe_{10}Cr_9$ Alloy," *Journal of Materials Science,* vol. 26, 1991, pp. 1647-1654.

Dong et al., "Neutron Diffraction Study of the Peritactic Growth of the $Al_{65}Cu_{20}Fe_{15}$ Icosahedral Quasi--Crystal," *Journal of Physics: Condensed Matter,* vol. 2, 1990, pp. 6339-6380.

Binger et al., "Resistance to Corrosion and Stress Corrosion," *Aluminum,* Chapter 7, vol. 1, pp. 208-276.

Degiovanni, "Identification de la Diffusivité Thermique par L'utilisation des Moments Temporeis Partiels," *High Temperatures-High Pressure,* vol. 17, 1985, pp. 683-689.

Taylor, "Intermetallic Phases in the Aluminium-Manganese Binary System," *ACTA Metallurgical,* vol. 8, Apr. 1960, pp. 256-262.

Lawther, "On the Question of Stability and Disorder in Icosahedral Aluminum—Transition Metal Alloys," *Canadian Journal of Physics,* vol. 67, No. 5, May 1989, pp. 463-467.

Berger et al., "Experimental Evidence for the Existence of Enhanced Density of States and Canonical Spin--Glass Behavior in Al-Mn (—S) Quasicrystals," *Physical Review B,* vol. 37, No. 11, Apr. 15, 1988, pp. 6525-6528.

Kuo, "Quasicrystals in Rapidly Solidified Alloys of Al-Pt Group Metals—I. An Overview of Quasicrystals in Aluminum-Transition Metal Alloys," *Journal of Less Common Metals,* vol. 163, 1990, pp. 9-17.

He et al., "Decagonal Quasicrystal with Different Periodioties Along the Tenfold Axis in Rapidly Solidified $Al_{65}Cu_{20}M_{16}$ (M-Mn, Fe, Co or Nl)," *Journal of Materials Science Letters,* vol. 7, 1988, pp. 1284-1286.

Masumoto, "Formation and Properties of Quasicrystals," *Chemical Abstracts,* vol. 106, 1987, p. 211.

ALUMINUM ALLOYS, SUBSTRATES COATED WITH THESE ALLOYS AND THEIR APPLICATIONS

This application is a continuation of application Ser. No. 07/934,627, now abandoned filed Sep. 18, 1992, which is the national phase filing of PCT/FR92/00030, filed Jan. 15, 1992.

BACKGROUND OF THE INVENTION

The present invention relates to alloys in which the essential constituent is aluminum, substrates coated with these alloys and the applications of these alloys, for example for forming thermal protection elements.

Diverse metals or metal alloys, for example aluminum alloys, have found numerous applications to date because of their valuable properties and in particular their mechanical properties, their good thermal conductivity, their lightness and their low cost. Thus, for example, cooking implements and equipment, anti-friction bearings, equipment mountings or supports and diverse articles obtained by molding are known.

However, the majority of these metals or metal alloys have drawbacks for some applications, associated with their inadequate hardness and resistance to wear and with their low resistance to corrosion, in particular in an alkaline medium.

Various attempts have been made to obtain improved aluminum alloys. Thus, European Patent 100287 describes a family of amorphous or microcrystalline alloys having improved hardness which can be used as reinforcing elements for other materials or in order to produce surface coatings improving the resistance to corrosion or wear. However, a large number of the alloys described in this patent are not stable at temperatures higher than 200° C. and during a heat treatment, in particular the treatment to which they are subjected in the course of deposition on a substrate, they change structure: return to the microcrystalline state if the alloys concerned are essentially amorphous, coarsening of the grains in the case of the essentially microcrystalline alloys which initially have a particle size of less than 1 micron. This change in crystalline or morphological structure gives rise to a change in the physical characteristics of the material, which essentially affects its density. This results in the appearance of microcracks, causing fragility, which have an adverse effect on the mechanical stability of the materials.

Another family of alloys has been described in EP 356287. These alloys have improved properties. However, their copper content is relatively high.

Thermal stability is an indispensable property if an alloy is to be able to be used as a thermal barrier.

Thermal barriers are assemblies of one or more materials intended to restrict the heat transfer towards or from equipment parts and components in numerous domestic or industrial devices. For example, mention may be made of the use of thermal barriers in heating or cooking devices, irons at the attachment of the hot part to the casing and the thermal insulation; in cars, at several points, such as the turbocompressor, the exhaust silencer, insulation of the body, etc.; and in aeronautics, for example on the rear part of compressors and reactors.

Thermal barriers are sometimes used on their own in the form of a shield, but very often they are directly combined with the source of heat or with the part to be protected, for reasons of mechanical strength. Thus, use is made of mica sheets, ceramic sheets and the like in domestic household appliances, fitting them by screwing or sticking, or of sheets of agglomerated glass wool supported by a metal sheet. A particularly advantageous process for combining a thermal barrier with a part, in particular a metal part, consists in depositing the material constituting the barrier on a substrate in the form of a layer of predetermined thickness by a thermal spraying technique, such as plasma spraying for example.

Very often it is recommended to combine the thermal barrier with other materials also deposited in the form of a layer by thermal spraying. These other materials may be intended to ensure that the barrier is protected from external attack, such as, for example, mechanical shocks, a corrosive medium, and the like, or may serve as a sublayer for bonding to the substrate.

The material most frequently used in aeronautics to form thermal barriers is yttrium-containing zirconia, which withstands very high temperatures. The zirconia deposit is produced by plasma spraying using a conventional technique, using the powdered material as starting material. Zirconia has a low thermal diffusivity ($\alpha=10^{-6}$ m$^2$/s). However, it has a relatively high specific mass d, which is a drawback for some applications; moreover, some of its mechanical properties, such as the hardness and the resistance to wear and to abrasion are poor.

Other materials are used as a thermal barrier. Mention may be made of alumina, which has a specific mass lower than that of zirconia and a diffusivity and a specific heat higher than those of zirconia, but has unsatisfactory mechanical properties. Mention may also be made of stainless steels and some refractory steels which offer thermal insulation properties, but which have a high specific mass.

SUMMARY OF THE INVENTION

The aim of the present invention is to provide a family of alloys having high hardness and thermal stability and improved ductility and corrosion resistance.

The present invention thus relates to a new family of alloys in which the essential constituent is aluminum.

The invention also relates to the metal coatings obtained from these alloys.

A further subject of the invention comprises the substrates coated with the said alloys.

Finally, a further subject comprises the applications of the said alloys.

The alloys of the present invention are characterized in:

that they have the following atomic composition (I):

$$Al_aCu_bCo_{b'}(B,C)_cM_dN_eI_f \quad (I)$$

in which:

$a+b+b'+c+d+e+f=100$, expressed as number of atoms $a \geqq 50$ $0 \leqq b < 14$ $0 \leqq b' \leqq 22$ $0 < b+b' \leqq 30$ $0 \leqq c \leqq 5$ $8 \leqq d \leqq 30$ $0 \leqq e \leqq 4$ $f \leqq 2$ M represents one or more elements chosen from Fe, Cr, Mn, Ni, Ru, Os, Mo, V, Mg, Zn and Pd;

N represents one or more elements chosen from W, Ti, Zr, Hf, Rh, Nb, Ta, Y, Si, Ge and the rare earths;

I represents the inevitable production impurities;

and in that they contain at least 30% by mass of one or more quasicrystalline phases.

DETAILED DESCRIPTION OF PREFERRED EMBODIMENTS

Figure 1:
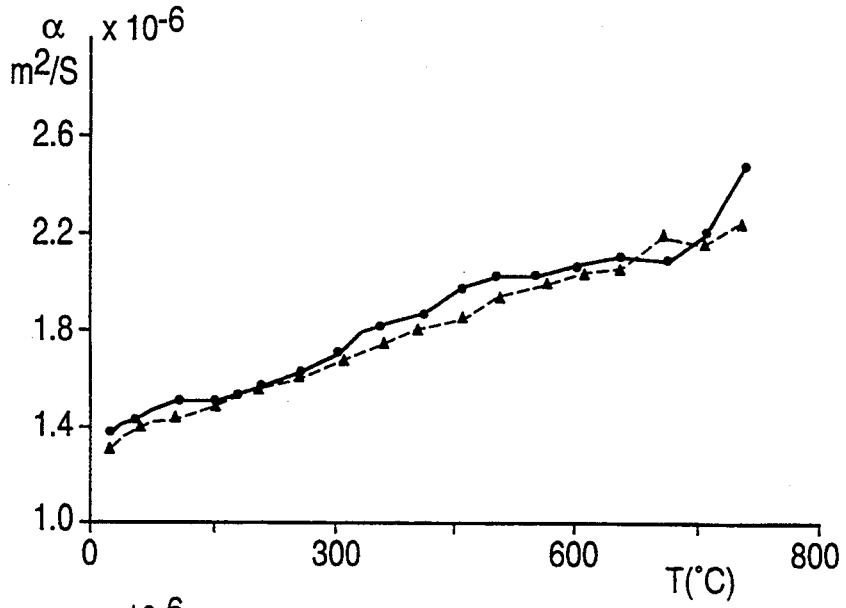
FIG. 1 shows the change in the thermal diffusivity $\alpha$ as a function of the temperature for the alloy n° 28.

In the present text the expression "quasicrystalline phase" encompasses:

1) the phases having rotational symmetries normally incompatible with the translational symmetry, that is to say symmetries of the axis of rotation of the order of 5, 8, 10 and 12, these symmetries being revealed by diffraction techniques. By way of example, the icosahedral phase I of point group $m\bar{3}\bar{5}$(cf. D. Shechtman, I. Blech, D. Gratias, J. W. Cahn, Metallic Phase with Long-Range Orientational Order and No Translational Symmetry, Physical Review Letters, Vol. 53, No. 20, 1984, pages 1951–1953) and the decagonal phase D of point group 10/mmm (cf. L. Bendersky, Quasicrystal with One Dimensional translational Symmetry and a Tenfold Rotation Axis, Physical Review Letters, Vol. 55, No. 14, 1985, pages 1461–1463) may be mentioned. The X-ray diffraction diagram of a true decagonal phase has been published in "Diffraction approach to the structure of decagonal quasicrystals, J. M. Dubois, C. Janot, J. Pannetier, A. Pianelli, Physics Letters A 117–8 (1986) 421–427".

2) The approximant phases or approximant compounds which are true crystals to the extent that their crystallographic structure remains compatible with the translational symmetry, but which have, in the electron diffraction pattern, diffraction figures for which the symmetry is close to the axes of rotation 5, 8, 10 or 12. Some of these nearest related phases have been identified in compounds of the prior art. Others have been demonstrated in some alloys of the present invention.

Amongst these phases, mention may be made, by way of example, of the orthorhombic phase $O_1$, characteristic of an alloy of the prior art having the atomic composition $Al_{65}Cu_{20}Fe_{10}Cr_5$, for which the lattice constants are: $a_o^{(1)}=2.366$, $b_o^{(1)}=1.267$, $c_o^{(1)}=3.252$ in nanometers. This orthorhombic phase $O_1$ is said to be approximant to the decagonal phase. It is, moreover, so close that it is not possible to distinguish its X-ray diffraction diagram from that of the decagonal phase.

Mention may also be made of the rhombohedral phase having the constants $a_R=3.208$ nm, $\alpha=36°$, present in the alloys having a composition close to $Al_{64}Cu_{24}Fe_{12}$ in number of atoms (M. Audier and P. Guyot, Microcrystalline AlFeCu Phase of Pseudo Icosahedral Symmetry, in Quasicrystals, Eds. M. V. Jaric and S. Lundqvist, World Scientific, Singapore, 1989).

This phase is a phase nearest related to the icosahedral phase.

Mention may also be made of the orthorhombic $O_2$ and $O_3$ phases having the respective constants $a_o^{(2)}=3.83$; $b_o^{(2)}=0.41$; $c_o^{(2)}=5.26$ and $a_o^{(3)}=3.25$; $b_o^{(3)}0.41$; $c_o^{(3)}=9.8$ in nanometers, present in an alloy of composition $Al_{63}Cu_{17.5}Co_{17.5}Si_2$ in number of atoms, or else the $O_4$ orthorhombic phase having constants $a_o^{(4)}=1.46$; $b_o^{(4)}=1.23$; $c_o^{(4)}=1.24$ in nanometers, which forms in the alloy of composition $Al_{63}Cu_8Fe_{12}Cr_{12}$, in number of atoms, of the present invention. The nearest related orthorhombic phases are described, for example, in C. Dong, J. M. Dubois, J. Materials Science, 26 (1991), 1647.

Mention may also be made of a phase C, of cubic structure, very frequently observed in co-existence with the nearest related or true quasicrystalline phases. This phase, which forms in some Al-Cu-Fe and Al-Cu-Fe-Cr alloys consists of a superstructure, by the effect of the chemical order of the alloying elements with respect to the aluminum sites, of a phase of typical structure Cs-Cl and lattice constant $a_1=0.297$ nm.

A diffraction diagram of this cubic phase has been published (C. Dong, J. M. Dubois, M. de Boissieu, C. Janot; Neutron diffraction study of the peritectic growth of the $Al_{65}Cu_{20}Fe_{15}$ icosahedral quasicrystal; J. Phys. Condensed Matter, 2 (1990), 6339–6360) for a sample of pure cubic phase of composition $Al_{65}Cu_{20}Fe_{15}$ in number of atoms.

Mention may also be made of a phase H of hexagonal structure which derives directly from phase C, as is shown by the epitaxial relationships observed by electron microscopy between crystals of phases C and H and the simple relationships which link the constants of the crystal lattices, that is to say $a_H=3\sqrt{2}a_1/\sqrt{3}$(to within 4.5%) and $c_H=3\sqrt{3}a_1/2$ (to within 2.5%). This phase is isotypical of a hexagonal phase, designated ΦAlMn, discovered in Al-Mn alloys containing 40% by weight of Mn [M. A. Taylor, Intermetallic phases in the Aluminum-Manganese Binary System, Acta Metallurgica 8 (1960) 256].

The cubic phase, its superstructures and the phases which are derived therefrom constitute a class of phases approximant to the quasicrystalline phases of closely related compositions.

Amongst the alloys of the present invention, mention may be made of those, designated (II) below, which have the abovementioned atomic composition (I) in which $0 \leqq b \leqq 5$, $0 \leqq b' \leqq 22$ and/or $0 < C \leqq 5$ and M represents Mn+Fe+Cr or Fe+Cr. These alloys (II) are more particularly intended for coating cooking utensils.

Another particularly valuable family, designated (III) below, has the abovementioned atomic composition (I), in which $15 < d \leqq b30$ and M represents at least Fe+Cr, with a Fe/Cr atomic ratio of <2. These alloys (III) have a particularly high resistance to oxidation.

Moreover, amongst the alloys (III) it is possible to distinguish a family of alloys (IV) particularly resistant to corrosion:

in a weakly acid medium ($5 \leqq pH < 7$) if $b > 6$, $b' < 7$ and $e \geqq 0$ where N is chosen from Ti, Zr, Rh and Nb, and in a strongly alkaline medium (up to $pH = 14$) if $b \leqq 2$, $b' > 7$ and $e \geqq 0$.

Another family of alloys (V) which are of interest because they offer an improved resistance to grain growth up to 700° C. has the composition of the alloys (I) where $0 < e \leqq 1$, N being chosen from W, Ti, Zr, Rh, Nb, Hf and Ta.

Another family of alloys (VI), having an improved hardness, has the composition of the alloys (I), where $b < 5$ and $b' \geqq 5$, preferably $b < 2$ and $b' > 7$.

Finally, the alloys (VII) having the composition (I) and which have an improved ductility are those for which $c > 0$, preferably $0 < c \leqq 1$, and/or $7 \leqq b' \leqq 14$.

The alloys of the present invention are distinguished from the alloys of the prior art, and in particular from those of EP 356 287, by their lower or even zero copper content. Because of this, the alloys are less susceptible to corrosion in an acid medium. Moreover, the low copper content is more favorable to the production of an improved ductility by the addition of other elements such as B or C. In the alloys of the present invention, copper may be completely or partially replaced by cobalt. These alloys are then particularly valuable with regard to the hardness, the ductility and the resistance to corrosion both in an alkaline medium and in an acid medium within the intermediate pH range ($5 \leqq pH \leqq 7$). The combination of these various properties offers a wide range of applications to the alloys of the present invention.

The alloys of the present invention may, for example, be used as wear-resistant surface or reference surface coating or to produce metal-metal or metal-ceramic joints. They are also suitable for all applications involving contact with foodstuffs.

The alloys of the invention, preferably those of group (VII), may also be used for shock-resistant surfaces.

For electrical or electrical engineering applications, or for high frequency heating, the alloys according to the invention of groups (III) and (V) will preferably be used.

The alloys of group (III) will preferably be used to produce surfaces resistant to oxidation, whereas those of groups (III) and (IV) are particularly suitable for surfaces resistant to corrosion.

The alloys of groups (III), (IV) and (VII) are particularly suitable for the production of cavitation-resistant or erosion-resistant surfaces.

The materials of the present invention, and more particularly those of group (V), may be used to produce elements for thermal protection of a substrate, in the form of a thermal barrier or in the form of a bonding sublayer for thermal barriers consisting of conventional materials. They have good thermal insulation properties, good mechanical properties, a low specific mass, good resistance to corrosion, especially to oxidation, and are very easy to use.

The materials of the present invention which can be used for the production of thermal protection elements according to the present invention have thermal diffusivity values $\alpha$ close to $10^{-6}$ m$^2$/s, which are very comparable with the thermal diffusivity of zirconia. Taking into account the lower specific mass d of these materials, the thermal conductivity $\lambda = \alpha d Cp$ in the vicinity of ambient temperature is not significantly different from that of zirconia. The quasicrystalline alloys of the present invention are therefore obvious substitutes for replacing numerous thermal barrier materials, and in particular zirconia, compared with which they have the advantages of low specific mass and excellent mechanical properties in respect of the hardness, the improved resistance to wear, to abrasion, to scratching and to corrosion.

The diffusivity of the materials forming the thermal protection elements of the present invention is reduced when the porosity of the materials increases. The porosity of a quasicrystalline alloy may be increased by a suitable heat treatment.

The materials forming the thermal protection elements of the present invention may contain a small proportion of heat-conducting particles, for example crystals of metallic aluminum. The heat conduction of the material will be dominated by the conduction properties of the matrix as long as the particles do not coalesce, that is to say as long as their proportion by volume remains below the percolation threshold. For particles which are approximately spherical and have a low radius distribution this threshold is at about 20%. This condition implies that the material forming the thermal protection element contains at least 80% by volume of quasicrystalline phases as defined above. Preferably, therefore, use is made of materials containing at least 80% of quasicrystalline phase, for their application as thermal barrier.

At temperatures below about 700° C., the thermal protection elements may be used as thermal barriers. Such temperature conditions correspond to the majority of domestic applications or applications within the automobile sector. Moreover, they are very capable of resisting the stresses due to the expansion of the support and their coefficient of expansion is between that of metal alloys and that of insulating oxides. Preferably, for temperatures higher than about 600° C., the quasicrystalline alloys forming the thermal barriers may contain stabilizing elements chosen from W, Zr, Ti, Rh, Nb, Hf and Ta. The stabilizing element content is less than or equal to 2% expressed as number of atoms.

The thermal barriers of the present invention may be multilayer barriers in which layers of materials which are good conductors of heat alternate with layers of materials which are poor conductors and which are quasicrystalline alloys. Abradable thermal barriers, for example, are structures of this type.

For applications in which the temperatures reach values higher than about 600° C., the thermal protection elements of the present invention may be used as bonding sub-layer for a layer serving as thermal barrier and consisting of a material of the prior art, such as zirconia. In these temperature ranges, the materials forming the thermal protection elements of the present invention become superplastic. They therefore meet the conditions of use required for the production of a bonding sublayer while being capable of themselves participating in insulation of the substrate. Thus, the thermal protection elements of the present invention may be used to within a few tens of degrees of the melting point of the material from which they are formed. This limit is at about 950° C. to 1200° C., depending on the composition.

The alloys according to the invention may be obtained by the conventional metallurgical production processes, that is to say processes which comprise a slow cooling stage (i.e. $\Delta T/t$ less than a few hundred degrees). For example, ingots may be obtained by melting separate metallic elements or prealloys in a brasque-lined graphite crucible under a blanket of protecting gas (argon, nitrogen), or a blanketing flow conventionally used in production metallurgy, or in a crucible kept under vacuum. It is also possible to use crucibles made of refractory ceramics or of cooled copper with heating by high frequency current.

The preparation of the powders required for the metalization process may be carried out, for example, by mechanical grinding or by spraying liquid alloy in a jet of argon in accordance with a conventional technique. The alloy production and spraying operations may take place in sequence without requiring casting of intermediate ingots. The alloys produced in this way may be deposited in thin form, generally up to a few tens of micrometers thick, but also in thick form, which may attain several millimeters, by any metalization technique, including those which have already been mentioned.

The alloys of the present invention may be used in the form of a surface coating by deposition from a preproduced ingot or from separate ingots of the elements, taken as targets in a cathodic sputtering reactor, or else by deposition of the vapor phase produced by melting the solid material under vacuum. Other methods, for example those which use sintering of agglomerated powder, may also be used. The coatings may also be obtained by thermal spraying, for example with the aid of an oxy-gas torch, a supersonic torch or a plasma torch. The thermal spraying technique is particularly valuable for the production of thermal protection elements.

The present invention will be explained in more detail with reference to the following nonlimiting examples.

The alloys obtained have been characterized in the raw production state by their X-ray diffraction pattern with a wavelength $\lambda=0.17889$ nm (cobalt anticathode), supplemented, if need be, by electron diffraction diagrams recorded on a Jeol 200 CX electron microscope.

Some alloys were subjected to holding at temperature under secondary vacuum or in air in order to evaluate their thermal stability and their capacity for resisting oxidation. The morphology of the phases and the grain size obtained in the raw production state were analyzed by optical micrography using an Olympus microscope.

The hardness of the alloys was determined using the Wolpert V-Testor 2 hardness tester under loads of 30 and 400 grams.

An estimate of the ductility of some alloys was obtained by measuring the length of the cracks formed from the angles of the impression under a load of 400 grams. A mean value of this length and of the hardness was evaluated from at least 10 different impressions distributed over the sample. Another estimate of the ductility lies in the amplitude of the deformation produced before rupture during a compression test applied to a cylindrical testpiece 4.8 mm in diameter and 10 mm high machined with perfectly parallel faces perpendicular to the axis of the cylinder. An Instrom tensile/compression machine was used.

Finally, the coefficient of friction of a 100C6 steel ball on a substrate coated with an alloy of the present invention was determined using a CSEM tribological tester of the pin/disk type.

The electrical resistivity of the samples was determined at ambient temperature on cylindrical test-pieces 20 mm long and 4.8 mm in diameter. The conventional method known as the 4-point method was used, with a constant measurement current of 10 mA. The voltage at the terminals of the inner electrodes was measured using a high precision nanovoltmeter. A determination was carried out as a function of the temperature with the aid of a specifically adapted furnace.

The melting points of a few alloys were determined on heating at a rate of 5° C./min. by differential thermal analysis on a Setaram 2000C apparatus.

The crystallographic structure of the alloys was defined by analysis of their X-ray diffraction pattern and their electron diffraction patterns.

EXAMPLE 1

Production of quasicrystalline alloys

A series of alloys has been produced by melting the pure elements in a high frequency field under an argon atmosphere in a chilled copper crucible. The total mass produced in this way was between 50 g and 100 g of alloy. The melting point, which depends on the composition of the alloy, was always found in the temperature range between 950 and 1200° C. While keeping the alloy in the molten state, a solid cylindrical testpiece 10 mm±0.5 mm in diameter and a few centimeters high was formed by drawing liquid metal into a quartz tube. The rate of cooling of this sample was close to 250° C. per second. This sample was then cut using a diamond saw to shape the metallography and hardness testpieces used in the examples below. Part of the testpiece was broken up for thermal stability tests and one fraction was ground to a powder for X-ray diffraction analysis of each alloy. An analogous assembly was used to obtain cylindrical testpieces 4.8 mm in diameter intended for the electrical resistivity. The rate of cooling of the testpiece was then close to 1000° C. per second.

Table 1 below gives the quasicrystalline phase content of the alloys according to the invention obtained, as well as the melting point of some of these.

The X-ray diffraction patterns and the electron diffraction patterns were recorded for the quasicrystalline alloys indicated in Table 1. Study of these alloys enabled the crystallographic nature of the phases present to be determined. Thus, for example, alloys nos. 2, 5, 7, 8, 9, 19 and 22 contain predominantly phase $O_1$ and alloy 1 contains predominantly phase C. Alloy 3 contains predominantly phase H. Alloy 6 consists essentially of phase H, as well as a small fraction of phase C. The other alloys contain variable proportions of phases C, $O_1$, $O_3$ and $O_4$ (and H in the case of 23).

TABLE 1

| Alloy No. | Composition | % by mass of quasi-crystalline phase | Melting point of the alloy |
|---|---|---|---|
| 1 | $Al_{64}Cu_{12}Fe_6Cr_6Ni_8Co_4$ | >90 | — |
| 2 | $Al_{70}Cu_9Fe_{10.5}Cr_{10.5}$ | >95 | 1040 |
| 3 | $Al_{70}Co_{10}Fe_{13}Cr_7$ | >95 | 1180 |
| 4 | $Al_{69}Cu_4Fe_{10}Cr_7Mn_{10}$ | ≧50 | |
| 5 | $Al_{68}Cu_8Fe_{12}Cr_{12}$ | ≧80 | 1080 |
| 6 | $Al_{65}Co_{18}Cr_8Fe_8$ | >95 | 1165 |
| 7 | $Al_{72}Cu_4Co_4Fe_{10}Cr_{10}$ | ≧60 | |
| 8 | $Al_{75}Cu_5Fe_{10}Cr_{10}$ | ≧80 | 1030 |
| 9 | $Al_{71.4}Cu_{4.5}Fe_{12}Cr_{12}B_{0.1}$ | ≧50 | |
| 10 | $Al_{73}Cu_{4.3}Co_{1.4}Fe_{11}Cr_{8.5}Ti_{0.7}Si_1$ | ≧40 | |
| 11 | $Al_{74.6}Cu_4Fe_{14}Cr_7C_{0.3}$ | ≧30 | |

TABLE 1-continued

| Alloy No. | Composition | % by mass of quasi-crystalline phase | Melting point of the alloy |
|---|---|---|---|
| 12 | $Al_{75}Cu_9Co_{16}$ | ≧80 | |
| 13 | $Al_{75}Cu_9Mn_{16}$ | ≧60 | |
| 14 | $Al_{75}Cu_9Fe_{16}$ | ≧80 | |
| 15 | $Al_{77.7}Cu_{0.8}Fe_9Mn_6B_{0.5}$ | ≧50 | 1060 |
| 16 | $Al_{74}Cu_2Co_6Fe_8Cr_8Ni_2$ | ≧70 | 1090 |
| 17 | $Al_{74}Cu_{2.5}Fe_{12}Cr_{12}B_{0.5}$ | >90 | |
| 18 | $Al_{69.3}Cu_{9.2}Fe_{10.6}Cr_{10.6}B_{0.3}$ | >90 | |
| 19 | $Al_{67.3}Cu_{8.9}Fe_{10.2}Cr_{10.3}B_{3.3}$ | >90 | |
| 20 | $Al_{62.2}Cu_{9.2}Fe_{10.6}Cr_{10.6}Zr_{0.3}$ | ≧80 | |
| 21 | $Al_{68.1}Cu_{9.1}Fe_{10.4}Zr_2$ | ≧30 | 1080 |
| 22 | $Al_{69.3}Cu_{9.2}Fe_{10.5}Cr_{10.6}Nb_{0.4}$ | ≧80 | 1100 |
| 23 | $Al_{66.8}Cu_1Co_4Mn_6Fe_{12}Cr_{10}B_{0.2}$ | ≧60 | |
| 24 | $Al_{69.8}Cu_1Co_7Fe_{12}Cr_{10}B_{0.2}$ | ≧40 | |
| 25 | $Al_{69.8}Cu_3Co_5Fe_{12}Cr_{10}B_{0.2}$ | ≧40 | 1090 |
| 26 | $Al_{69.8}Co_8Fe_{12}Cr_{10}B_{0.2}$ | ≧50 | |
| 27 | $Al_{66.8}Co_{4.5}Mn_{6.5}Fe_{12}Cr_{10}B_{0.2}$ | ≧50 | |
| 28 | $Al_{69.5}Cu_9Fe_{10.5}Cr_{10.5}Hf_{0.5}$ | ≧95 | |
| 29 | $Al_{69.5}Cu_9Fe_{10.5}Cr_{10.5}Ta_{10.5}$ | >95 | |
| 30 | $Al_{69.5}Cu_9Fe_{10.5}Cr_{10.5}W_{0.5}$ | >95 | |
| 31 | $Al_{69.5}Co_{10}Fe_{13}Cr_7Hf_{0.5}$ | >95 | |
| 32 | $Al_{69.5}Co_{10}Fe_{13}Cr_7Ta_{0.5}$ | >95 | 1155 |
| 33 | $Al_{69.5}Co_{10}Fe_{13}Cr_7W_{0.5}$ | >95 | |
| 34 | $Al_{67}Cu_9Fe_{10.5}Cr_{10.5}Si_3$ | >95 | |
| 35 | $Al_{63.5}Cu_{8.5}Fe_{10}Cr_{10}Si_{2.5}B_{5.5}$ | >90 | |
| 36 | $Al_{62}Co_{16}Fe_8Cr_8Mn_1Ni_1Hf_4$ | >90 | |
| 37 | $Al_{62}Co_{16}Fe_8Cr_8Mn_1Ni_1Nb_4$ | >70 | |
| 38 | $Al_{66}Co_{14}Ni_{14}Mn_2Hf_4$ | >60 | |
| 47 | $Al_{70}Co_{15}Ni_{15}$ | >95 | |

EXAMPLE 2

Production of a quasi-crystalline alloy in a large quantity

A one hundred (100) kilogram bath of an alloy producing a mass fraction of more than 95% of quasicrystalline phase was produced. The nominal composition of the alloy was $Al_{67}Cu_{9.5}Fe_{12}Cr_{11.5}$ expressed as number of atoms (alloy 39). This composition was produced from industrial metal components, that is to say aluminum A5, a Cu-Al-Fe alloy containing 19.5% Al by weight, 58.5% Cu by weight and 21.5% Fe by weight. These elements and alloys were introduced cold into an alumina-lined graphite crucible. They were melted under a blanketing flow which was maintained until the end of the operation. A 125 kW high-frequency current generator was used. After melting this batch and homogenizing its temperature at 1140° C., pure iron, in the form of bars 8 mm in diameter, and then Al-Cr briquettes containing 74% by weight of chromium and 14% by weight of flux were added to obtain the nominal composition of the alloy. After homogenization, all of the melt was cast to give 2-kg ingots. Two samples taken, respectively, at the middle of casting and at the end, were analyzed by a wet method and gave two very close compositions of $Al_{66.8}Cu_{9.4}Fe_{12.2}Cr_{11.5}Mn_{0.1}$ expressed as number of atoms. The proportion of impurities, carbon and sulfur, was found to be less than 0.1 at. %. X-ray diffraction examination of several ingot samples, reduced to powder form, shows diffraction patterns corresponding to the phase $O_1$, approximant to the true decagonal phase.

The specific heat of the alloy was determined in the temperature range 20°–80° C. using a Setaram scanning calorimeter. The thermal diffusivity of a pellet of this alloy 15 mm thick and 32 mm in diameter was deduced from the temperature/time curve measured on one face of the pallet knowing that the opposite, previously blackened face has been irradiated by a laser flash of calibrated power and form. The thermal conductivity is deduced from the above two determinations, knowing the specific mass of the alloy, which has been determined using Archimedes' method by immersion in butyl phthalate kept at 30° C. (±0.1° C.) and found to be 4.02 g/cm$^3$.

Example 3 Comparative

Production of alloys of the prior art

By way of comparison, a series of alloys known from the prior art was produced using the process of Example 1. These compositions are collated in Table 2 below. The alloys contained at most 30% by mass of quasicrystalline phase, except for that for which the atomic copper content was higher than 18%.

TABLE 2

| Alloy No. | Composition | % by mass of quasi-crystalline phase |
|---|---|---|
| 40 | $Al_{65.5}Cu_{18.5}Fe_8Cr_8$ | >95 |
| 41 | $Al_{85}Fe_{15}$ | <10 |
| 42 | $Al_{85}Cr_{15}$ | ≦30 |
| 43 | $Al_{85}Cu_{15}$ | 0 |
| 44 | $Al_{85}Mo_{15}$ | 0 |
| 45 | $Al_{95}C_3Fe_2$ | 0 |
| 46 | $Al_{90}Cu_5Fe_5$ | 0 |

EXAMPLE 4

Thermal stability

The thermal stability of a few alloys of the present invention has been evaluated. The alloys selected were subjected to holding at various temperatures for durations ranging from a few hours to several tens of hours. Fragments extracted by breaking the ingots produced according to Example 1 were placed in quartz ampoules sealed under secondary vacuum. The volume of these fragments was of the order of 0.25 cm$^3$. The ampoules were placed in a furnace preheated to the treatment temperature. At the end of the treatment, they were cooled under vacuum to ambient temperature by natural convection in air or at a controlled rate. The fragments were then ground for examination by X-ray diffraction. Examinations by electron diffraction were also carried out. The experimental conditions of the heat treatments are summarized in Table 3 below.

TABLE 3

| Treatment No. | Alloy No. | Holding temp. | Holding period in hours | Cooling in air or cooling rate |
|---|---|---|---|---|
| T2 | 2 | 950° C. | 5 | air |
| T3 | 5 | 800° C. | 6 | 0.5° C./min |
| T4 | 5 | 950° C. | 5 | 5° C./min |
| T5 | 7 | 800° C. | 30 | 0.5° C./min |
| T6 | 8 | 950° C. | 5 | 5° C./min |
| T7 | 9 | 800° C. | 6 | 0.5° C./min |

The structural development of the alloys during isothermal treatment in the present example was assessed by comparison with the X-ray diffraction patterns recorded, respectively, before and after the heat treatment. It is surprising to find that these patterns show no major modification, either in respect of the number of diffraction lines or in their relative intensities. However, thinning of the diffraction lines is observed, which is due to the well-known phenomenon of grain coarsening at high temperature.

The alloys of the present invention are stable to heat in the sense that their structure, as characterized by the appropriate diffraction patterns, is not essentially changed during isothermal heat treatments at temperatures which can reach the melting point of the alloys. In other words, the mass fraction of quasi-crystalline phase present in the raw production state is not reduced during holding at temperature.

EXAMPLE 5

Resistance to oxidation

Fragment samples identical to those described in Example 4 were subjected to heat treatment in a furnace open to the air, under the conditions summarized in Table 4 below.

TABLE 4

| Treatment No. | Alloy No. | Holding temp. | Holding period |
|---|---|---|---|
| T9 | 2 | 400° C. | 75 hrs |
| T10 | 23 | 500° C. | 24 hrs |
| T11 | 28 | 500° C. | 24 hrs |
| T12 | 29 | 500° C. | 24 hrs |
| T13 | 30 | 500° C. | 24 hrs |
| T14 | 31 | 500° C. | 24 hrs |
| T15 | 32 | 500° C. | 24 hrs |
| T16 | 33 | 500° C. | 24 hrs |

Comparison of the diffraction patterns of the samples before treatment with those recorded at the end of the heat treatments in air shows that the samples have not undergone any alteration. More precisely, no trace of grain coarsening is detectable from the widths of the diffraction lines, which have remained identical to those of the patterns characteristic of the raw production state.

EXAMPLE 6

Morphology and grain size

The alloys of the present invention, produced by the method of Example 1, are polycrystalline materials, the morphology of which was studied by optical microscopy using a conventional metallographic technique. For this purpose, pellets 10 mm in diameter (produced by the method of Example 1) were finely polished and then etched with a suitable metallographic reagent. The metallographic images were photographed using an Olympus optical microscope, working in white light. The grain size observed is between a few micrometers and a few tens of micrometers.

The same method of characterization was applied to the samples treated in air in the temperature range from 400° C. to 500° C. as described in Table 4 of the above example. On the metallographic images thus obtained it was found that the alloys have not undergone grain coarsening at the end of these heat treatments. It follows that the polycrystalline morphology of these materials, which determines numerous thermomechanical properties, in particular the macroscopic hardness ($H^{v}_{400}$), the coefficients of friction, the elastic limit and the resilience, is not sensitive to holding at temperatures which may reach at least 500° C. for at least several tens of hours, including in the presence of air.

EXAMPLE 7

Hardness and ductility at ambient temperature

The Vickers hardnesses of the alloys of the present invention and of some alloys of the prior art were determined at ambient temperature on fragments of alloys produced by the process of Example 1, embedded in a resin for metallographic use and then finely polished. Two microhardness tester loads of, respectively, 30 g and 400 g were used. The results are given in Table 5 below.

The Vickers hardnesses observed for the alloys of the present invention are particularly high in comparison with the Vickers hardnesses under a load of 400 grams recorded for the alloys of the prior art produced as in Example 3 (samples 41 to 46).

The presence of cobalt in the alloys of the present invention singularly increases the hardnesses observed since some values exceed $H^{v}_{400}=800$.

In general, the ductility of the alloys having a high hardness is relatively low. However, it is found, surprisingly, that the alloys of the present invention containing cobalt have a higher ductility. In the case of the alloys of the present invention which do not contain cobalt, it is possible to improve the ductility by virtue of additions, for example of boron or of carbon. For simple assessment of the effect of such additions on the ductility of some alloys, the mean length of the cracks which form from the angles of the Vickers impressions under a load of 400 grams were measured. This length is the shorter the more ductile the alloy. A few results are reported in Table 5.

TABLE 5

| Alloy No. | $H^{v}_{30g}$ | $H^{v}_{400g}$ | Mean length of crack (μm) |
|---|---|---|---|
| 2 | 530 | 650 | 54 |
| 3 | 655 | 840 | 20 |
| 4 | 670 | 700 | |
| 5 | 540 | 540 | |
| 6 | | 845 | 46 |
| 7 | 700 | 770 | 46 |
| 8 | 430 | 620 | |
| 9 | 450 | 660 | |
| 15 | 360 | 660 | |
| 16 | 610 | 775 | 90 |
| 17 | 570 | 620 | |
| 18 | 520 | 660 | 33 |
| 19 | 460 | 690 | |
| 20 | 560 | 680 | |
| 22 | 540 | 730 | |
| 23 | 650 | 795 | |
| 24 | 610 | 715 | |
| 25 | 550 | 775 | |
| 26 | | 825 | 39 |
| 28 | 510 | 700 | 37 |
| 29 | 410 | 710 | 43 |
| 30 | 510 | 690 | 40 |
| 31 | 580 | 830 | 40 |
| 32 | 520 | 830 | 55 |
| 33 | 530 | 820 | 41 |
| 41 | | 210 | |
| 42 | | 340 | |
| 43 | | 170 | |
| 44 | | 310 | |
| 45 | | 110 | |
| 46 | | 170 | |

In addition a compression test was carried out with alloy 2 of Example 1, which does not contain boron, and alloy 19, modified by the addition of 3.3 atomic % of boron. The test was carried out at ambient temperature, under increasing load, on cylindrical testpieces 4.8 mm in diameter and 10 mm high. The surfaces of the cylinder to which the load is applied were very carefully machined to be perfectly parallel to one another and perpendicular to the axis of the cylinder. According to the deformation-compression stress curves which were recorded during deformation of testpieces of alloys 2 and 19 (as produced by the method of Example 1), it was found that the addition of boron doubles the deformation obtained at break, which reaches about 2%, and the breaking point, which exceeds 1000 MPa.

EXAMPLE 8

Electrical resistivity at ambient temperature

Resistivity determinations were carried out for the alloys according to the invention and, by way of comparison, for compositions of the prior art. In all cases cylindrical testpieces prepared by the method of Example 1 were used.

The results obtained are collated in Table 6 below.

Compositions 41 to 46 and 40 are alloys of the prior art; the others are alloys according to the invention.

The compositions of the prior art have an electrical resistivity at ambient temperature which is between a few $\mu\Omega$ cm and a few tens of $\mu\Omega$ cm. However, an exception is observed in the case of alloy 42, which has the composition $Al_{85}Cr_{15}$ expressed as number of atoms and has a resistivity of 300 $\mu\Omega$ cm. This value is to be related to the presence of a proportion of quasicrystalline phase which is fairly close to, although less than, 30% by mass. However, this state is metastable and has been produced only by virtue of the high cooling rate which characterizes the production method for the present testpieces.

TABLE 6

| Alloy No. | Mass fraction of quasicrystalline phase | Electrical resistivity at ambient temp. in $\mu\Omega$ cm |
|---|---|---|
| 41 | <10 | 22 |
| 42 | ≦30 | 300 |
| 43 | 0 | 4 |
| 44 | 0 | 32 |
| 45 | 0 | 6 |
| 46 | 0 | 11 |
| 40 | >95 | 230 |
| 2 | >95 | 575 |
| 3 | >95 | 520 |
| 4 | ≧50 | 590 |
| 7 | ≧60 | 395 |
| 8 | ≧80 | 380 |
| 16 | ≧70 | 370 |
| 17 | >90 | 530 |
| 23 | ≧60 | 330 |
| 24 | ≧40 | 420 |
| 25 | ≧40 | 460 |

The characteristic values of the electrical resistivity of the alloys of the present invention are between 300 and 600 $\mu\Omega$ cm. Such high values make the quasicrystalline alloys of the present invention suitable for all applications where this property must be put to use, such as, for example, heating by the Joule effect, resistances with high calorific dissipation, and electromagnetic coupling, which may be high frequency.

Moreover, a representative alloy of family (III) has a low temperature coefficient of the electrical resistivity ($1/\rho d\rho/dT$). The relative variation in the electrical resistivity with temperature was determined for a testpiece of alloy 2. This testpiece was prepared from a strip 0.1 mm thick and 1.2 mm wide produced by quenching the liquid alloy on a copper drum, the surface of which was rotating at a speed of 12 m/s (technique known as melt spinning). The ingot heated to the liquid state had been produced by the method of Example 1. The testpiece was heated at a constant rate of 5° C./min and kept in contact with four platinum wires in accordance with the method of determination known as the four-point method. The gap between potential electrodes was 20 mm and the voltage was measured using a precision nanovoltmeter. A constant current of 10 mA circulated in the testpiece through the other two electrodes. The measuring device was kept under a protective argon flow in an appropriate furnace. It was found that the variation in resistance is linear, which demonstrates that there is no transformation of the sample either during the determination or during the subsequent heating cycle, confirming the high thermal stability of the alloys (Example 4). The temperature coefficient derived from the $(1/\rho(20° C.))\text{-}(\rho(T)\text{-}\rho(20° C.)/\Delta T$ curve is $-3.10^{-4}$. This low value distinguishes the alloy for applications where it is preferable to retain the characteristics of the material within a narrow range as a function of the temperature, such as, for example, heating by electromagnetic induction.

EXAMPLE 9

Corrosion resistance

The dissolution of some alloys of the present invention, and that of an alloy of the prior art, in various media was determined.

The samples tested are:

alloy No. 40 of the prior art containing 18.5% of Cu
alloy No. 2 of the invention containing 9% of Cu
alloy No. 3 of the invention containing 10% of Co and 0% of Cu
alloy No. 6 of the invention containing 18% of Co and 0% of Cu.

To determine the degree of dissolution, a testpiece 10 mm in diameter and 3 mm thick, produced by the method of Example 1, was immersed for 30 h in a corrosive solution at various temperatures. The solution was stirred throughout the immersion period and kept at temperature by means of a thermostat-controlled bath. After 30 hours, the loss in weight of each testpiece was determined.

The results are collated in Table 7 below. The figures given represent the loss in weight of the sample in $gm^{-2}h^{-1}$. N.D. denotes "not detected".

TABLE 7

| | Medium | | | | | |
|---|---|---|---|---|---|---|
| | 10% $HNO_3$ pH = 5 | | 20% $HNO_3$ pH = 4 | | Pure NaOH | Pure KOH |
| Sample | 20° C. | 35° C. | 20° C. | 70° C. | 20° C. | 20° C. |
| No. 40 | 30 | 25 | 35 | 230 | | |
| No. 2 | N.D. | N.D. | 7 | 45 | | |
| No. 3 | | | | | N.D. | N.D. |
| No. 6 | | | | | N.D. | N.D. |

It is well-known that the addition of copper reduces the corrosion resistance of aluminum alloys (Chapter 7 of Aluminum, Vol. I, Ed. K. R. Van Horn, American Society for Metals). In a dilute acid medium, for example, aluminum alloys have a high degree of dissolution which usually falls as the acid content increases. In the proximity of 100% acid concentration, this degree of dissolution again increases very substantially. Conversely, on the alkaline side, the behavior of aluminum alloys is satisfactory until the pH rises above pH=12. The passivating alumina film which protects them is then able to go into solution and aluminum alloys usually have very low resistance to corrosion in a highly alkaline medium.

The above tests show that the present invention provides alloys which have excellent resistance to corrosion in an acid medium (No. 2, having a Cu content higher than 5 atomic %), or in a strongly alkaline medium (Nos. 3 and 6, having a cobalt content higher than 5 atomic %).

Thus, the quasi-crystalline alloys of the present invention combine several properties which single them out very particularly for numerous applications in the form of surface coatings: high hardness, low but not negligible ductility, stability to heat and high resistance to corrosion. The following example will show that these alloys retain these properties after their use as surface coating. They then have a surprisingly low coefficient of friction, which adds to the range of valuable properties already mentioned.

EXAMPLE 10

Use of an alloy of the present invention for the production of a surface deposit A two-kilogram ingot of the alloy produced according to Example 2 was reduced to powder by grinding using a carbon steel concentric pebble mill. The powder thus obtained was sieved so as to retain only the particle fraction having a size between a minimum of 25 μm and a maximum of 80 μm. A 0.5 mm thick deposit was then produced by spraying this powder onto a sheet of previously sandblasted mild steel. This spraying was carried out using a Metco flame torch fed by a mixture containing 63% of hydrogen and 27% of oxygen. The operation was carried out under a protective atmosphere of nitrogen containing 30% hydrogen, so as to prevent any oxidation of the sample. After removal of the surface roughness by mechanical polishing, examination by X-ray diffraction showed that the alloy deposited consisted of at least 95% of icosahedral phase. The testpiece, consisting of the steel substrate provided with its quasicrystalline coating, was then divided into two parts by sectioning and one of these parts was subjected to a heat treatment at 500° C. in air as indicated in Example 4. A study of the X-ray diffraction pattern recorded for the treated sample shows no major modification in the structure after holding at temperature for 28 hours and confirms the very high thermal stability of the alloy, including after the surface metalization operation. Table 8 below summarizes the results of the hardness determinations carried out, as in Example 7, before and after heat treatment. The value determined for the ingot before reduction to powder is also given.

TABLE 8

| | Raw production ingot (Ex. 2) | Deposit before treatment | Deposit after treatment 28 h 500° C. air |
|---|---|---|---|
| Vickers hardness | | | |
| $H_v^{30}$ | 640 | 525 | |
| $H_v^{400}$ | 550 | 510 | 610 |
| Coefficient of friction | — | 0.26–0.30 | 0.23–0.25 |

TABLE 8-continued

| | Raw production ingot (Ex. 2) | Deposit before treatment | Deposit after treatment 28 h 500° C. air |
|---|---|---|---|
| Brinell 100C6 ball $\mu = F_t(N)/F_n(=5N)$ | | | |

In addition, the coefficient of friction of a Brinell ball, made of 100C6 steel used for tools, on the deposit of the present example was determined using a CSEM tribological tester of the pin-disk type. A normal force $F_n=5N$ was applied to the friction piece normal to the plane of the deposit. The force of resistance to the movement of the friction piece $F_t(N)$, measured (in newtons) tangentially to the movement, gives the coefficient of friction $\mu=F_t(N)/F_n$, under constant normal force, which is given in Table 8. It should be noted that the values in Table 8 are comparable to, or even substantially better than, the values obtained for other materials used in tribological applications.

EXAMPLE 11

Thermal diffusivity at ambient temperature

The thermal diffusivity $\alpha$, the specific mass d and the specific heat Cp were determined in the vicinity of ambient temperature for several samples prepared according to Example 1 and a sample prepared according to Example 2. The samples produced by the method of Example 1 are pellets 10 mm in diameter and 3 mm thick. The sample of Example 2 is a pellet 32 mm in diameter and 15 mm thick.

The opposite faces of each pellet were polished mechanically under water, taking great care to guarantee their parallelism. The structural state of the testpieces was determined by X-ray diffraction and by electron microscopy. All of the samples selected contained at least 90% by volume of quasi-crystalline phase according to the definition given above.

The thermal conductivity is given by the product $\lambda=\alpha dCp$.

The thermal diffusivity $\alpha$ was determined using a laboratory apparatus combining the laser flash method with a Hg-Cd-Te semiconductor detector. The laser was used to supply pulses having a power of between 20 J and 30 J and a duration of $5.10^{-4}$ s to heat the front face of the testpiece, and the semiconductor thermometer served to detect the thermal response on the opposite face of the testpiece. The thermal diffusivity was derived from experiments carried out in accordance with the method described in "A. Degiovanni, High Temp. - High Pressure, 17 (1985) 683".

The specific heat of the alloy was determined in the temperature range 20°–80° C. using a Setaram scanning calorimeter.

The thermal conductivity $\lambda$ is derived from the above two determinations, knowing the specific mass of the alloy, which was determined by the Archimedes method by immersion in butyl phthalate kept at 30° C. (±0.1° C.).

The values obtained are given in Table 9. By way of comparison, this table contains the values relating to a few materials of the prior art (samples 5 to 13), some of which are known to be thermal barriers (samples 5 to 8).

In Table 9 the letter symbols in the last column have the meaning given above.

TABLE 9

| Alloy No. | Composition | $\alpha$ $m^2s^{-1} \cdot 10^6$ | d $kg\ m^{-3}$ | Cp $Jkg^{-1}k^{-1}$ | $\lambda = \alpha d\ Cp$ $Wkg^{-1}K^{-1}$ | % by mass of quasi-crystalline phase |
|---|---|---|---|---|---|---|
| 2 | $Al_{70}Cu_9Fe_{10.5}Cr_{10.5}$ | 0.75 | 3940 | 620 | 1.8 | >95 O/D |
| 3 | $Al_{70}Co_{10}Fe_{13}Cr_7$ | 1.55 | 400 | 625 | 3.9 | >95 C/H |
| 4 | $Al_{69}Cu_4Fe_{10}Cr_7Mn_{10}$ | 0.75 | | | | ≧50 O/D |
| 6 | $Al_{65}Co_{18}Cr_8Fe_8$ | 1.5 | | | | >95 C/H |
| 7 | $Al_{72}Cu_4Co_4Fe_{10}Cr_{10}$ | 1.10 | 3950 | 675 | 2.9 | >90 O/D |
| 8 | $Al_{75}Cu_5Fe_{10}Cr_{10}$ | 1.65 | 3800 | 670 | 4.2 | >90 O/D |
| 9 | $Al_{71.4}Cu_{4.5}Fe_{12}Cr_{12}B_{0.1}$ | 0.85 | | | | >95 O/D |
| 15 | $Al_{77.7}Cu_{0.8}Fe_9Mn_6Cr_6B_{0.5}$ | 1.4 | | 680 | | >90 O/D |
| 28 | $Al_{69.5}Cu_9Fe_{10.5}Cr_{10.5}Hf_{0.5}$ | 1.35 | | | | >90 O/D |
| 30 | $Al_{69.5}Cu_9Fe_{10.5}Cr_{10.5}W_{0.5}$ | 0.93 | 3980 | | | >95 O/D |
| 31 | $Al_{69.5}Co_{10}Fe_{13}Cr_7Hf_{0.5}$ | 1.0 | | | | >95 C/H |
| 33 | $Al_{69.5}Co_{10}Fe_{13}Cr_7W_{0.5}$ | 1.25 | | | | >90 C/H |
| 34 | $Al_{67}Cu_9Fe_{10.5}Cr_{10.5}Si_3$ | 0.80 | 4000 | 630 | 2.0 | >95 O/D |
| 35 | $Al_{63.5}Cu_{8.5}Fe_{10}Cr_{10}Si_{2.5}B_{5.5}$ | 1.10 | 4100 | 670 | 3.0 | >90 O/D |
| 36 | $Al_{62}Co_{16}Fe_8Cr_8Mn_1Ni_1Hf_4$ | 1.35 | 4870 | | | >90 C/H |
| 37 | $Al_{62}Co_{16}Fe_8Cr_8Mn_1Ni_1Nb_4$ | 2.0 | 4690 | | | >70 C/H |
| 38 | $Al_{66}Co_{14}Ni_{14}Mn_2Hf_4$ | 2.3 | 4830 | | | >60 D |
| 39 | $Al_{67}Cu_{9.5}Fe_{12}Cr_{11.5}$ | 1.015 | 4020 | 600 | 2.45 | >95 O |
| 47 | $Al_{70}Co_{15}Ni_{15}$ | 1.55 | 4100 | 600 | | >95 D |
| 50 | Al fcc | 90–100 | 2700 | 900 | 230 | |
| 60 | $Al_2O_3$ | 8.5 | 3800 | 1050 | 34 | |
| 70 | stainless steel | 4 | 7850 | 480 | 15 | |
| 80 | $ZrO_2$—$Y_2O_3$ 8% | 0.8 | 5700 | 400 | 2 | |
| 90 | $Al_6Mn$ | 5.4 | | | | |
| 100 | $Al_{13}Si_4Cr_{14}$ | 7.4 | | | | |
| 110 | $Al_5Ti_2Cu$ | 7.0 | | | | |
| 120 | $Al_7Cu_2Fe$ | 6.2 | | | | |
| 130 | $Al_2Cu$ | 14–17 | | | | |

These results reveal that, at ambient temperature, the thermal conductivity of the quasi-crystalline alloys forming the protection elements of the present invention is considerably lower than that of the metallic materials (aluminum metal or tetragonal $Al_2Cu$), given by way of comparison. It is two orders of magnitude lower than that of aluminum and one order of magnitude lower than that of stainless steel, which is usually considered to be a good thermal insulator. Moreover, it is lower than that of alumina and entirely comparable with that of zirconia doped with $Y_2O_3$, considered to be the archetypal thermal insulator in the industry.

By way of comparison, the thermal diffusivity of alloys 90, 100, 110, 120 and 130 was determined. These alloys, which form defined aluminum compounds, have compositions close to those of the quasi-crystalline alloys which can be used for the protection elements of the present invention. However, they do not have the quasi-crystalline structure defined above. In all cases, their thermal diffusivity is higher than $5.10^{-6}\ m^2/s$, that is to say well above that of the alloys used for the present invention.

EXAMPLE 12

Thermal diffusivity as a function of the temperature

The values of $\alpha$ were recorded as a function of the temperature up to 900° C.

The thermal diffusivity was determined using the method of Example 11. Each testpiece was placed under a flow of purified argon in the center of a furnace heated by the Joule effect; the rate of rise in temperature, programmed by computer, varied linearly at 5° C./min. All of the samples according to the present invention show an approximately linear increase in $\alpha$ with the temperature. The value of $\alpha$ determined at 700° C. is close to twice that determined at ambient temperature. Similarly, the specific heat increases with the temperature and reaches 800 to 900 J/kgK at 700° C. The specific mass falls by the order of 1 to 2%, as is indicated by thermal expansion or neutron diffraction determinations. Consequently, the thermal conductivity remains below 12 W/mK, that is to say below the thermal conductivity of stainless steels which are used for some thermal insulation applications.

Figure 2:
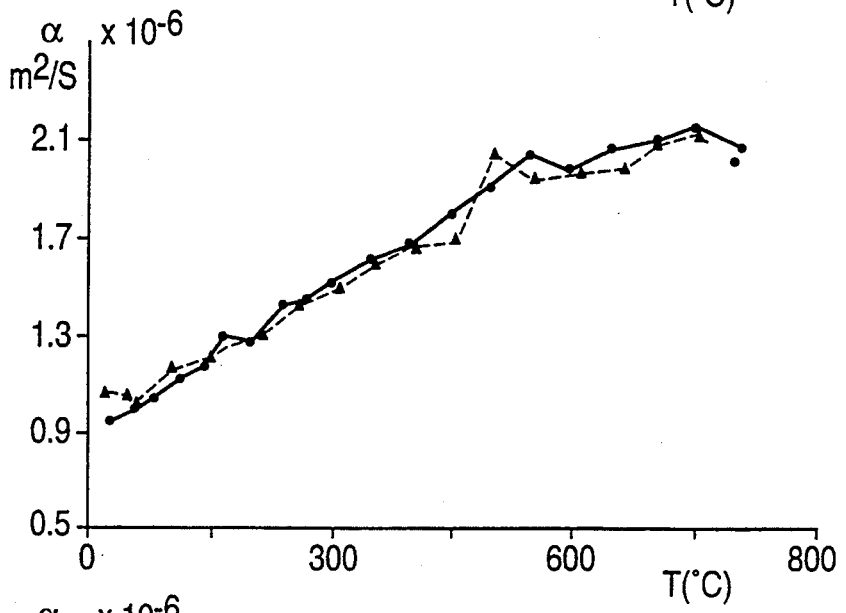
FIG. 2 shows the change in the thermal diffusivity $\alpha$ as a function of the temperature for the alloy n° 31.
Figure 3:
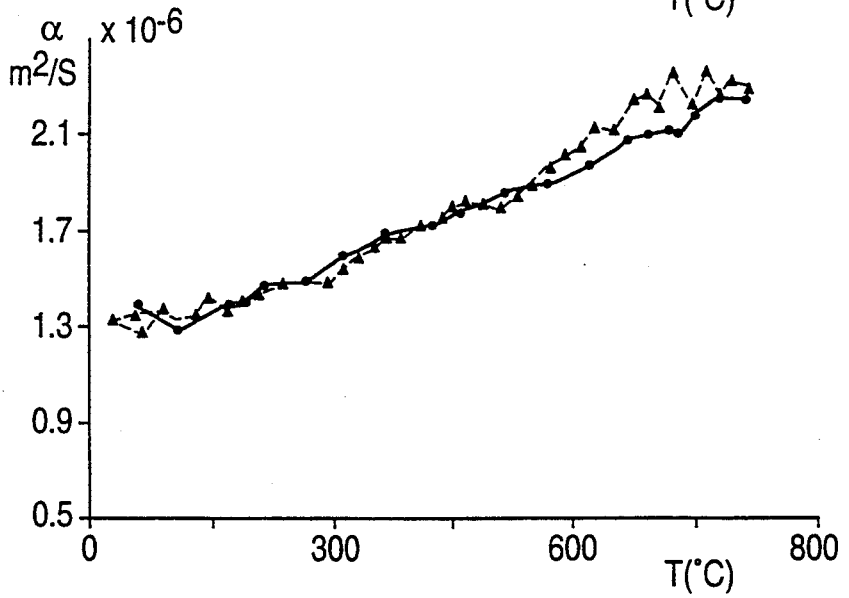
FIG. 3 shows the change in the thermal diffusivity $\alpha$ as a function of the temperature for the alloy n° 33.

FIGS. 1, 2 and 3 show, respectively, the change in $\alpha$ as a function of the temperature for alloys 28, 31 and 33. The measurements recorded during heating are represented by black triangles and those recorded during cooling by black circles.

EXAMPLE 13

The variation in the thermal expansion of alloy 2 was determined. The thermal expansion curve shows that the coefficient of expansion shows very slight dependence on the temperature and is $9.10^{-6}$/° C., a value close to that of stainless steels.

EXAMPLE 14

The superplastic behavior of some alloys capable of forming the thermal protection elements of the present invention was studied. Cylindrical testpieces 4 mm in diameter and 10 mm long, having strictly parallel faces, were produced by the same method as those of Example 1 using alloys 34 and 35. These testpieces were subjected to mechanical tests under compression in an Instrom machine. Tests were carried out up to a load of 250 MPa, at a speed of movement of the beam of 50 μm/min, the temperature being kept constant at between 600° and 850° C. The two alloys show superplastic behavior from 600° C.

EXAMPLE 15

Production of thermal protection elements according to the invention and according to the prior art.

A first series of testpieces was produced. The substrate was a solid copper cylinder having a diameter of 30 mm and a height of 80 mm and the coating was applied using a plasma torch in accordance with a conventional technique. Testpiece C0 is the uncoated copper cylinder. Testpiece C1 was coated over its entire surface with a 1 mm thick layer of alloy 2 and testpiece C2 was coated with a 2 mm thick layer of alloy 2. Testpiece C5 comprises a layer of alloy 2 forming the thermal protection element of the present invention serving as bonding layer and a layer of yttrium-containing zirconia. Testpieces C3 and C4, which serve for comparison, comprise, respectively, a layer of yttrium-containing zirconia and a layer of alumina. Another series of testpieces was produced using, as support, a stainless steel tube having a length of 50 cm, a diameter of 40 mm and a wall thickness of 1 mm (testpieces A0 to A2). In each case, the support tube is coated at one of its ends over a length of 30 cm. In the latter case, the deposits were produced using an oxy-gas torch. Table 10 below shows the nature and the thickness of the layers for the various testpieces. The accuracy in respect of the final thicknesses of the deposits was ±0.3 mm.

Figure 4:
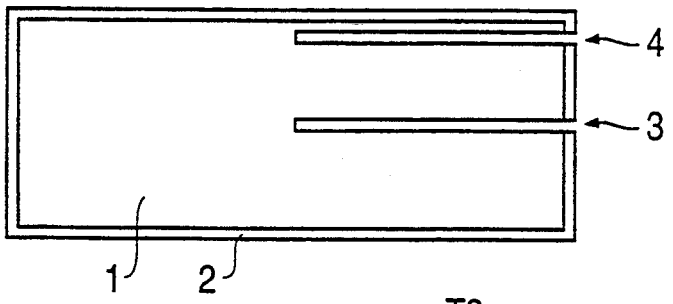
FIG. 4 shows a test piece of the copper cylinder type 1 comprising a coating 2 and provided with a central thermocouple 3 and a side thermocouple 4, both being inserted as far as midway of the length of the cylinder.
Figure 5:
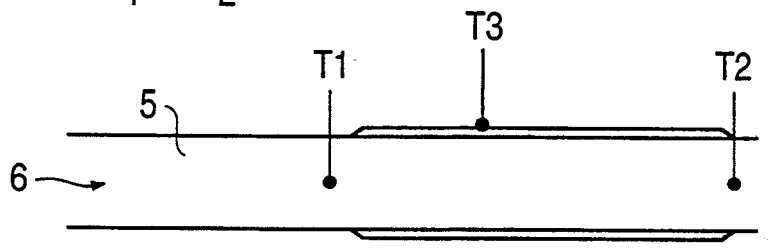
FIG. 5 shows a test piece of a hollow tube type, with a hollow type 5 through which a stream of hot air 6 is passed and which is provided with three thermocouples T1, T2 and T3, respectively.

All of the testpieces were provided with Chromel-Alumel thermocouples of very low inertia. FIG. 4 shows a testpiece of the type comprising a copper cylinder 1 carrying a coating 2 and provided with a central thermocouple 3 and a lateral thermocouple 4, the two being inserted to half the length of the cylinder. FIG. 5 shows a hollow tube 5, into which a flow of hot air 6 is passed and which is fitted with three thermocouples denoted, respectively, by T1, T2 and T3, the first two being inside the tube and placed, respectively, at the start of the coated area and at the end of the coated area, and the third being on the outer surface of the coating.

EXAMPLE 16

Use of protection elements as protection with regard to a flame

Testpieces C0, C1, C2, C3, C4 and C5 were placed with their base on a refractory brick. Successive heat pulses of 10 s duration were applied to each testpiece at intervals of 60 s and the response of the thermocouples was recorded. These pulses were produced by the flame of a torch placed at a constant distance from the testpiece and facing the thermocouple close to the surface. The flow rate of the combustion gases was carefully controlled and kept constant throughout the experiment. Two series of experiments were carried out: one using testpieces initially at 20° C. and the other using testpieces initially at 650° C.

Testpieces C0 to C5 enable three parameters to be defined which summarize the results of the experiment, that is to say the maximum difference P in temperature between the two thermocouples, $\Delta T/\Delta t$, the rate of rise in temperature of the lateral thermocouple 4 during the pulse, and the increase in temperature $\Delta T$ produced in the center of the testpiece (thermocouple 3). These data are given in Table 10. It was found that the zirconia layer of testpiece C3 did not resist more than three pulses and was cracked from the time of the first pulse. Sample C2 did not start to crack until the sixth pulse and sample C1 resisted more than 50 pulses. These results show that the protection elements of the present invention, used as thermal barrier, show performances which are at least equivalent to those of zirconia.

EXAMPLE 17

Use of the protection elements according to the invention as sub-layer for a thermal barrier In testpiece C5 the thermal protection element of the present invention forms a sub-layer. It was found that the zirconia layer of testpiece C3 did not resist more than three heat pulses and was cracked from the time of the first pulse. For testpiece C5, which was also subjected to a series of heat pulses, the surface temperature of the zirconia deposit, measured by a third thermocouple placed in contact with the deposit at the end of the tests, stabilized at 1200° C. The experiment extended to 50 pulses and testpiece C5 resisted these without apparent damage, although the coefficient of expansion of copper is close to twice that of the quasi-crystalline alloy, which would imply high shear stresses at the substrate/deposit interface if the material of the sub-layer did not become plastic. The thermal protection elements of the present invention are therefore suitable for the production of bonding sub-layers, in particular for thermal barriers.

TABLE 10

| | | 20–100° C. | | | 650–550° C. | | |
|---|---|---|---|---|---|---|---|
| | Coating material | ΔT ±0.5° C. °C. | ΔT/Δt °C./s | P ±0.5° C. °C. | ΔT ±0.5° C. °C. | ΔT/Δt °C./s | P ±0.5° C. °C. |
| CO | None | 27 | 2.85 | 5.4 | 22 | 2.3 | <1 |
| C1 | $Al_{70}Cu_9Fe_{10.5}$-$Cr_{10.5}$ 1 mm | 24 | 2.8 | 3.8 | 11 | 1.1 | 6 |
| C2 | $Al_{70}Cu_9Fe_{10.5}$-$Cr_{10.5}$ 2 mm | 18 | 1.3 | 0 | 25 | 0.3 | 4.7 |
| C5 | $Al_{70}Cu_9Fe_{10.5}$-$Cr_{10.5}O$.5 mm $ZrO_2$—$Y_2O_3$ 8% 1 mm | 23 | 2.6 | 4.2 | 13 | 1.2 | 2.5 |
| C3 | Yttrium-containing zirconia 1 mm | 24 | 2.75 | 4.7 | 14 | 1.5 | 2.3 |
| C4 | Alumina 1 mm | 27 | 2.7 | 6.5 | 25 | 3.0 | 8.2 |
| A0 | None | — | — | — | — | — | — |
| A1 | $Al_{65}Co_{18}Cr_8Fe_8$ | — | — | — | — | — | — |

TABLE 10-continued

| | Coating material | 20–100° C. ΔT ±0.5° C. °C. | ΔT/Δt °C./s | P ±0.5° C. °C. | 650–550° C. ΔT ±0.5° C. °C. | ΔT/Δt °C./s | P ±0.5° C. °C. |
|---|---|---|---|---|---|---|---|
| A2 | 1.5 mm $Al_{70}Cu_9Fe_{10.5}Cr_{10.5}$ 1.5 mm | — | — | — | — | — | — |

EXAMPLE 18

Application of a thermal protection element of the present invention for the insulation of a reactor.

Testpieces A0, A1 and A2 were used to assess the suitability of the alloys of the invention for the thermal insulation of an apparatus. The testpieces were each provided with 3 thermocouples T1, T2 and T3 as shown on FIG. 5. A stream of hot air at constant flow rate was passed through the stainless steel tube forming the substrate of each testpiece. The air temperature at the inlet, measured using thermocouple T1, was 300°±2° C. The surface temperature, measured using thermocouple T3, was recorded as a function of time from the time the hot air generator was switched on. Thermocouple T2 made it possible to verify that the transient conditions for establishment of the flow of hot air were identical for all determinations.

Figure 6:
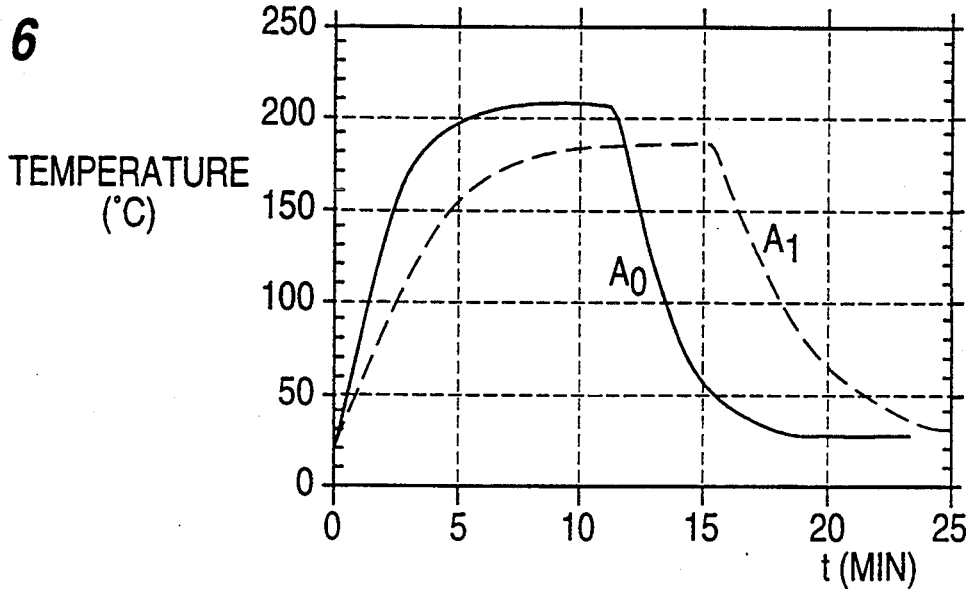
FIG. 6 shows the change in the surface temperature of the samples A1 and A0.
Figure 7:
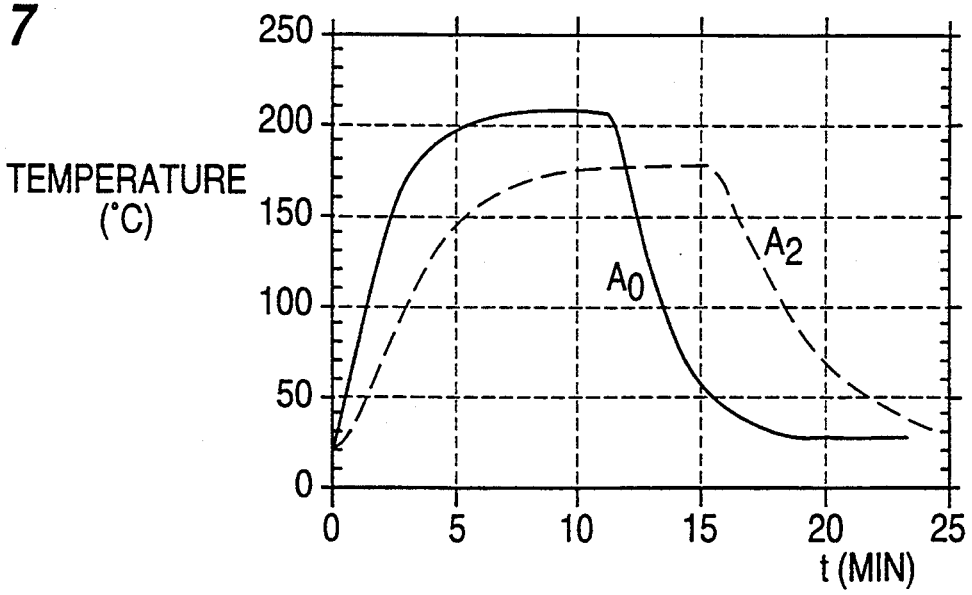
FIG. 7 shows the change in the surface temperature of the samples A2 and A0.

FIGS. 6 and 7 show the change in the surface temperature of each of the testpieces A0, A1 and A2 as a function of time. At equilibrium, the surface temperature of testpiece A0 (without coating) is about 35° C. higher than that of testpiece A2 and 27° C. higher than that of testpiece A1. The thermal protection elements of the present invention give interesting results with regard to thermal insulation.

We claim:

1. An alloy having the following atomic composition:

$$Al_aCu_bCO_{b'}(B, C)_cM_dN_eI_f \quad (I)$$

$a+b+b'+c+d+e+f=100$, wherein expressed as number of atoms $a \geqq 50$, $0 \leqq b < 12$ $0 \leqq b' \leqq 22$, $0 < b+b' \leqq 30$, $0 \leqq c \leqq 5$, $8 \leqq d \leqq 30$, $0 \leqq e \leqq 4$, and $f \leqq 2$, and wherein M represents one or more elements selected from the group consisting of Fe, Cr, Mn, Ni, Ru, Os, Mo, V, Mg, Zn, and Pd;

N represents one or more elements selected from the group consisting of W, Ti, Zr, Hf, Rh, Nb, Ta, Y, Si, Ge, and the rare earths; and I represents impurities;

at least 30% by mass of said alloy comprising one or more quasi-crystalline phases and the remainder of said alloy comprising a crystalline phase.

2. An alloy according to claim 1, wherein $0 \leqq b \leqq 5$, and M represents Mn+Fe+Cr or Fe+Cr.

3. An alloy according to claim 1, wherein $15 < d \leqq 30$, and wherein M represents at least Fe+Cr, with a Fe/Cr atomic ratio of <2.

4. An alloy according to claim 3, wherein $b > 6$, $b' < 7$ and $e > 0$ and N is selected from the group consisting of Ti, Zr, Rh, and Nb.

5. An alloy according to claim 3, wherein $b \leqq 2$, $b' > 7$, and $e \geqq 0$.

6. An alloy according to claim 1, wherein $0 < e \leqq 1$, and N is selected from the group consisting of W, Ti, Zr, Rh, Nb, Hf, and Ta.

7. An alloy according to claim 1, wherein $b < 5$ and $b' > 5$.

8. An alloy according to claim 7, wherein $b < 2$ and $b' > 7$.

9. An alloy according to claim 1, wherein $0 < c \leqq 1$ and/or $7 \leqq b' \leqq 14$.

10. An alloy according to claim 1, wherein the alloy is obtained in the form of a solid part.

11. An alloy according to claim 1, wherein the alloy is obtained in the form of a deposit on a substrate.

12. A substrate coated with an alloy according to claim 1.

13. An alloy according to claim 11, wherein the substrate is a cooking utensil.

14.. An alloy according to claim 1, wherein b is zero.

15. An alloy according to claim 1, wherein the alloy has a thermal diffusivity value of about $10^{-6}$ $m^2/s$.

16. An alloy according to claim 1, wherein the alloy contains at least 80% by volume of said one or more quasicrystalline phases.

17. An alloy according to claim 16, wherein the alloy contains heat-conducting particles.

18. An alloy according to claim 1, wherein the alloy has a melting point of between 950° and 1200° C.

19. An alloy according to claim 1, wherein b' is zero.

20. An alloy according to claim 1, wherein the alloy contains at least 60% by mass of one or more of said quasi-crystalline phases.

21. An alloy according to claim 1, wherein b is at least 4.

22. An alloy according to claim 1, wherein b' is at least 4.

23. An alloy according to claim 1, wherein c is 0.

24. An alloy according to claim 1, which comprises at most six atomic percent of iron.

25. An alloy according to claim 1, wherein the alloy is produced by a method which comprises a step of slow cooling at a rate of less than a few hundred degrees C per second.

* * * * *